US006677832B1

(12) United States Patent
Guinn et al.

(10) Patent No.: US 6,677,832 B1
(45) Date of Patent: Jan. 13, 2004

(54) CONNECTOR FOR DIFFERENTIAL-MODE TRANSMISSION LINE PROVIDING VIRTUAL GROUND

(75) Inventors: Keith V. Guinn, Basking Ridge, NJ (US); Louis Thomas Manzione, Summit, NJ (US); Ming-Ju Tsai, Livingston, NJ (US); Hui Wu, Union, NJ (US)

(73) Assignee: Lucent Technologies Inc., Murray Hill, NJ (US)

( * ) Notice: Subject to any disclaimer, the term of this patent is extended or adjusted under 35 U.S.C. 154(b) by 0 days.

(21) Appl. No.: 09/698,582

(22) Filed: Oct. 27, 2000

(51) Int. Cl.[7] ..... H01P 5/00
(52) U.S. Cl. ..... 333/116; 333/4; 333/161
(58) Field of Search ..... 333/4, 26, 246, 333/233, 161, 116, 109, 112

(56) References Cited

U.S. PATENT DOCUMENTS

| | | | | |
|---|---|---|---|---|
| 5,075,646 A | * | 12/1991 | Morse | 333/116 |
| 5,157,361 A | * | 10/1992 | Gruchalla et al. | 333/20 |
| 5,321,375 A | * | 6/1994 | Corman | 333/246 |
| 5,430,247 A | * | 7/1995 | Bockelman | 174/250 |
| 5,534,830 A | * | 7/1996 | Ralph | 333/128 |
| 5,965,273 A | * | 10/1999 | Walpita et al. | 428/457 |
| 5,982,249 A | * | 11/1999 | Bruns | 333/1 |
| 6,000,120 A | * | 12/1999 | Arledge et al. | 29/600 |

FOREIGN PATENT DOCUMENTS

WO WO 99/40627 8/1999

OTHER PUBLICATIONS

Joseph Fjelstad, "Controlled Impedance Signal Transmission," Flexible Circuit Technology, 30, 1998.
Giga, "Flexguide HF Interconnect," Application Note, Sep., 1998 (Patent Pending).
Yamanaka, Naoaki et al., "320 Gb/s High–Speed ATM Switching System Hardware Technologies Based on Copper–Polyimide MCM", IEEE Trans. on Components, Packaging and Manufacturing Technology, Part B, vol. 18, No.1, Feb., 1995, 83–91.

* cited by examiner

*Primary Examiner*—Robert Pascal
*Assistant Examiner*—Kimberly E Glenn

(57) ABSTRACT

An electrical connecting element is disclosed comprised of a dielectric substrate having two conductor paths disposed on opposite sides and being substantially aligned with one another. The electrical connecting element employs differential-mode signaling such that the first conductor path carries a signal of opposite polarity to the second conductor path. A virtual ground exists between the differential + and − lines that permits an otherwise "groundless" differential transmission line. The substantial alignment of the first and second conductor paths improves the space constraints, relative to conventional electrical connecting elements. The characteristic impedance of the disclosed differential transmission line depends on the width of the trace lines the thickness of the dielectric substrate.

25 Claims, 3 Drawing Sheets

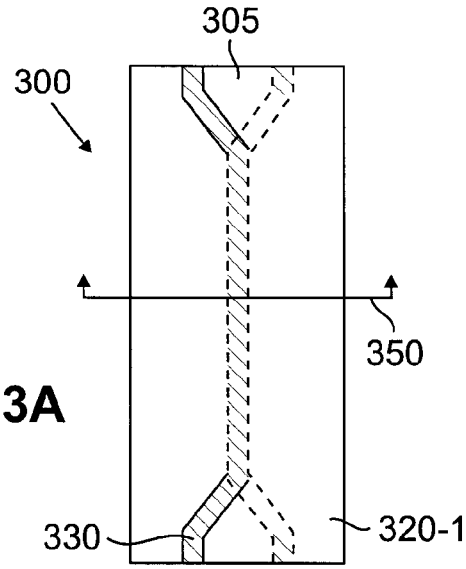
FIG. 3A
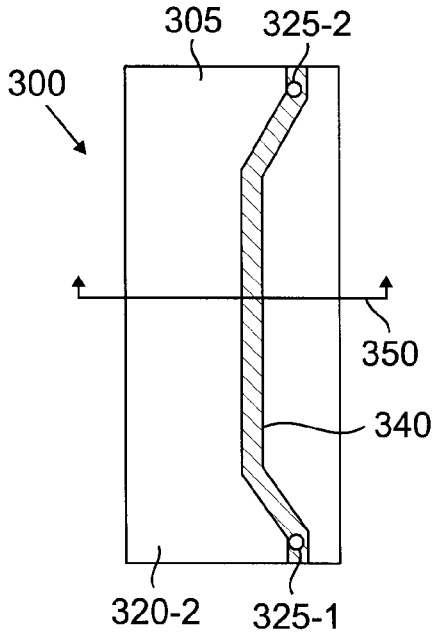
FIG. 3B
FIG. 3C
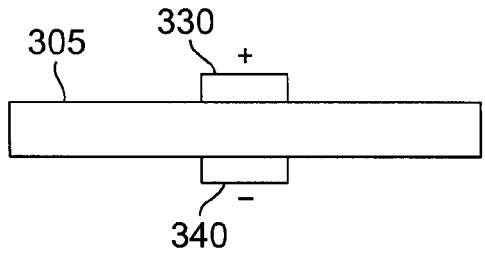

CONNECTOR FOR DIFFERENTIAL-MODE TRANSMISSION LINE PROVIDING VIRTUAL GROUND

FIELD OF THE INVENTION

The present invention relates to electrical connecting elements, and more particularly to differential-mode connecting elements for use in transmission lines.

BACKGROUND OF THE INVENTION

Communication networks transfer information, such as data, voice, text or video information, among communication devices connected to the networks. Most recent developments in communication technologies have been motivated by a desire to increase the available bandwidth of such communication networks to ever increasing levels. In addition, even the local communications associated with a computing device, such as communications on the read and write channels of a computer storage hard disk are also increasing, with bandwidth requirements currently approaching 1 GHz.

The need for such increasing bandwidth levels requires the electronic systems that participate in such communications to likewise operate at higher frequencies. The increased data rates required of such electronic systems requires a corresponding increase in the stringent requirements on the interconnection of active devices, passive devices, and package elements, such as integrated circuit elements within a semiconductor device. The traditional interconnection method of wire bonding does not meet the required electrical performance for broadband devices, primarily due to the bond wire inductance. Specifically, the wires used in such wire bonding techniques cause an inductance that attenuates the transferred signal levels at the required data rates. Therefore, wire bond interconnection poses a significant technical hurdle to overcome if broadband communication systems will be produced.

A number of interconnection techniques have been proposed or suggested that attempt to overcome such series inductance. For example, PCT Application Number WO 99/40627, assigned to GIGA A/S of Skovlunde, Denmark, discloses a flexible electrical connecting element 100, shown in FIG. 1, that is formed as a coplanar wave-guide on a dielectric substrate 105. A signal-carrying conductor path 110 and conductor paths 120, 130 on each side of the signal-carrying conductor path 110 constitute a ground plane. The electric fields in the conventional connecting elements 100 shown in FIG. 1 are created in the gaps 150, 160 between the conductor paths 110, 120, 130.

While such flexible electrical connecting elements 100 have significantly reduced the series inductance problem associated with conventional wire bond interconnection techniques, and perform effectively for many communication applications, they suffer from a number of limitations, which if overcome, could further reduce the overall dimensions and improve the impedance matching characteristics of such flexible electrical connecting elements. Specifically, high-speed electronics typically rely on integrated circuits (ICs) utilizing differential mode signal transmission for improved performance, relative to common mode signal transmission. In a differential signal mode, two lines, referred to as + and −, are required. Each of the data lines will have opposite current and opposite voltage at the same point on the line. To accomplish differential mode signal transmission using the electrical connecting elements 100 shown in FIG. 1, however, two such electrical connecting elements 100 are required. Alternatively, as shown in FIG. 2, a differential mode connecting element 200 can be accomplished using two signal-carrying lines 210, 220 and two ground lines 230, 240. Either of these constructions requires additional area to accomplish the interconnection. A need therefore exists for a flexible electrical connecting element that allows differential mode signal transmission to be employed without significantly increasing the required surface area.

In addition, another important characteristic of connecting elements used in transmission lines is the characteristic impedance of the interconnect 100. For most high data rate applications, transmission lines with characteristic impedances of 25 to 75 ohms are increasingly common. It is often a challenge, however, to obtain flexible interconnects that satisfy the impedance matching demands of high date rate communication devices. With the flexible interconnects shown in FIG. 1, desired impedance properties can be obtained by varying the width and gaps between of the conductor lines 110, 120, 130 and the dielectric constant of the dielectric substrate 105. Very fine gaps between the conductor lines 110, 120, 130 are typically required to achieve the required characteristic line impedance.

The accurate patterning of these gaps requires fine line lithography of the conductor 110. A small error in the conductor pattern will change the characteristic impedance of the flexible interconnect 100 and reduce the transmission bandwidth. Thus, the desired impedance strongly influences the geometry and material properties of the conventional flexible interconnects 100. A need therefore exists for a new flexible interconnect that offers additional degrees of freedom for varying the characteristic impedance.

SUMMARY OF THE INVENTION

Generally, an electrical connecting element is disclosed that is comprised of a dielectric substrate having a first conductor path (positive/+) on a first side and a second conductor path (negative/−) on a second side, substantially aligned with the first conductor path. The electrical connecting element employs differential-mode signaling such that the first conductor path carries a signal of opposite polarity to the second conductor path. The present invention recognizes that a virtual ground exists between the differential + and − lines for a differential mode transmission line. The presence of the virtual ground permits a "groundless" differential transmission line. In addition, the substantial alignment of the first and second conductor paths improves the space constraints, relative to conventional electrical connecting elements.

According to another aspect of the invention, the characteristic impedance of the disclosed differential transmission line depends on the thickness and dielectric constant of the dielectric substrate and the width of the trace, which is significantly larger than the gap of the conventional flexible interconnect discussed above. Therefore, the required resolution of the conductor lithography is relaxed. Thus, the line widths and substrate thickness may be varied to provide a variety of designs and thereby accommodate a wide range of impedance requirements that would not be possible using the conventional interconnect structures discussed above.

A more complete understanding of the present invention, as well as further features and advantages of the present invention, will be obtained by reference to the following detailed description and drawings.

BRIEF DESCRIPTION OF THE DRAWINGS

FIGS. 3A, 3B and 3C illustrate a top, bottom and end view of a flexible differential-mode electrical connecting element in accordance with the present invention.

DETAILED DESCRIPTION

Figure 1:
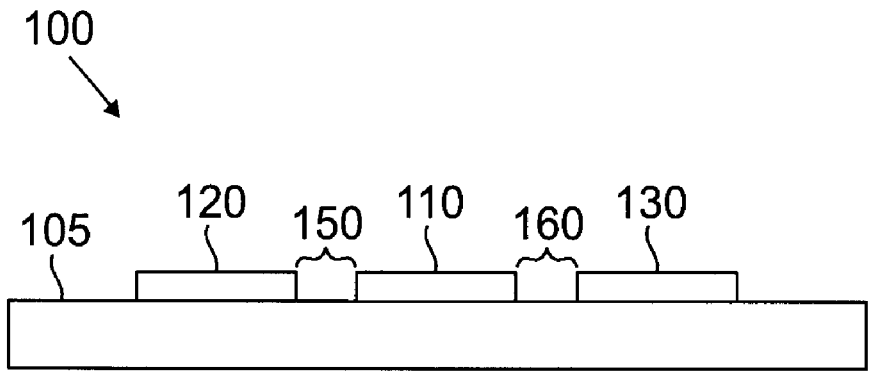
FIG. 1 (PRIOR ART)
FIG. 1 illustrates a conventional flexible electrical connecting element.

The present invention recognizes that a virtual ground exists between the differential + and – lines for a differential mode transmission line. The present invention exploits this feature to form a "groundless" differential transmission line 300, shown in FIGS. 3A, 3B and 3C, thereby reducing the inductance of the interconnection. In other words, the opposite current and voltage that are inherent in the differential-mode signaling tend to minimize the effect of disturbing electric fields (noise).

As shown in FIGS. 3A and 3B, a differential transmission line 300 in accordance with the present invention consists of a flexible dielectric sheet material 305 with patterned conductor material on both sides. Specifically, as shown in FIG. 3A, a first side 320-1, such as a top side of the flexible dielectric sheet material 305, has a first signal-carrying (+) conductor path 330. As shown in FIG. 3B, a second side 320-2, such as a bottom view of the flexible dielectric sheet material 305, has a second signal-carrying (–) conductor path 340. As further shown in FIG. 3B, vias 325-1, 325-2 are used to electrically connect the conductor material of the signal-carrying (–) conductor path 340 on one side 320-1 to conductor material on the other side 320-2. As shown in FIG. 3A, the first and second signal-carrying (+) conductor paths 330, 340 are located substantially directly over one another (i.e., are aligned) for most of their length. FIG. 3C shows a view of the differential transmission line 300, taken along the line 350. The first (+) and second (–) signal-carrying conductor paths 330 and 340 separate at the ends of the differential transmission line 300 to facilitate interconnection to a device with connections points separated in the interconnection plane.

The dielectric material 305 should have a small loss tangent to minimize dielectric losses for the transmission line. In addition, the conductor material in the conductor paths 330, 340 should have high conductivity and be smoothly finished to minimize the conductor losses of the transmission line. The conductor should have a conductivity similar to copper that has a conductivity of 5.8e+7 Siemens/m. The conductor should have a surface roughness that is small in comparison to the electrical skin depth at the highest frequency of interest. For example, at 36 GHz, the electrical skin depth is approximately 0.3 micrometers. In this case, a surface roughness of one fifth of the electrical skin depth or 0.06 micrometers would generally be considered a smooth surface. As the surface roughness increases, the surface resistance will increase and degrade the performance of the transmission line. Furthermore, the dielectric film 305 should have a constant thickness, be accurately patterned and exhibit consistent material properties. For example, polyimide film (dielectric film) coated with copper (conductor) can be a suitable material system for the differential transmission line 300.

Thus, the embodiment shown in FIGS. 3A through 3C relies on an internal virtual ground plane, which would be located between the top and bottom conductor paths 330, 340 (best seen in FIG. 3C). The virtual ground comes free by taking advantage of the differential mode signal characteristics and the positioning of the conductor paths 330, 340.

According to another feature of the present invention, the characteristic impedance of the differential transmission line 300 depends on the width of the trace lines 330, 340, (which is significantly larger than the gap of the conventional flexible interconnect 100 shown in FIG. 1). Therefore, there is a relaxation of the required resolution of the conductor lithography and substrate thickness. The characteristic impedance of the differential transmission line 300 may be obtained using electromagnetic simulation.

Figure 4:
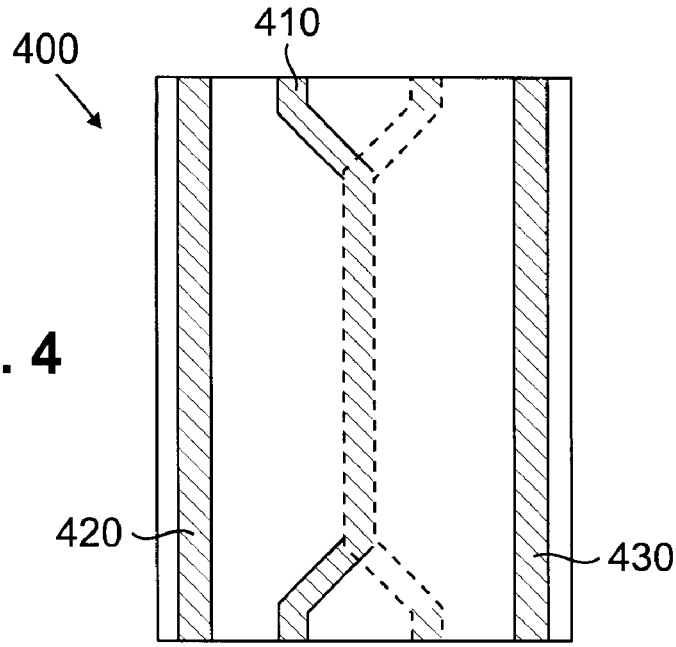
FIGS. 4 and 5 illustrate further variations of flexible differential-mode electrical connecting elements in accordance with the present invention.
Figure 5:
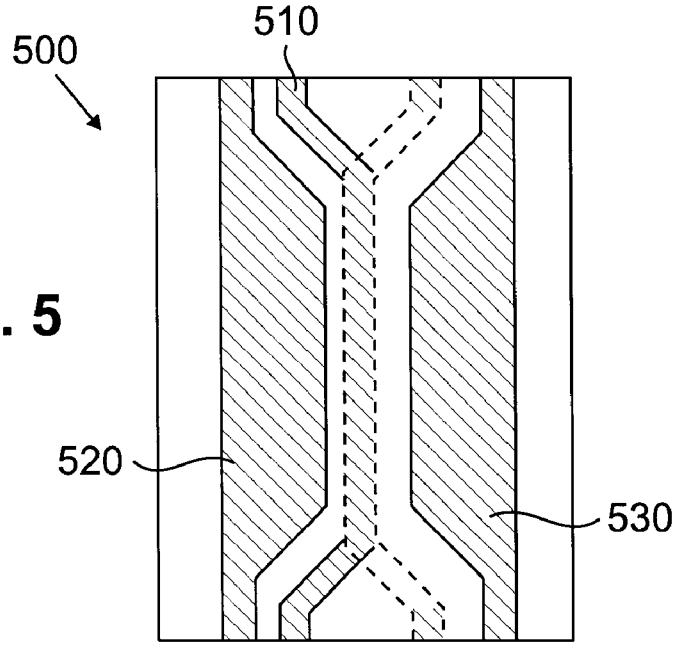

FIGS. 4 and 5 illustrate two further variations of the present invention, where two additional grounding strips 420, 430 (FIG. 4) and 520, 530 (FIG. 5) are positioned on the substrate 400, 500, respectively, on either side of signal-carrying conductor 410, 510. The additional grounding strips 420, 430 (FIG. 4) and 520, 530 (FIG. 5) facilitate the assembly, but they do not have to significantly contribute electro-magnetically to the reduction of inductance. In addition, the variations shown in FIGS. 4 and 5 do not suffer from the real estate problem and hence performance degradation of the coplanar design of FIG. 1, due to insufficient grounding because of limited space. The transmission line constructions show in FIGS. 4 and 5 provide for improved disturbing electric fields (noise) immunity by better shielding the + and – lines. Typically, the + and – lines are not perfect in terms of balanced current and some path, such as these ground lines, is required to ensure the net current is zero. The ground lines can be used to provide ground potential interconnection or alternatively a floating potential interconnection. The additional ground lines strengthen the interconnection piece and allow for easier assembly.

Figure 2:
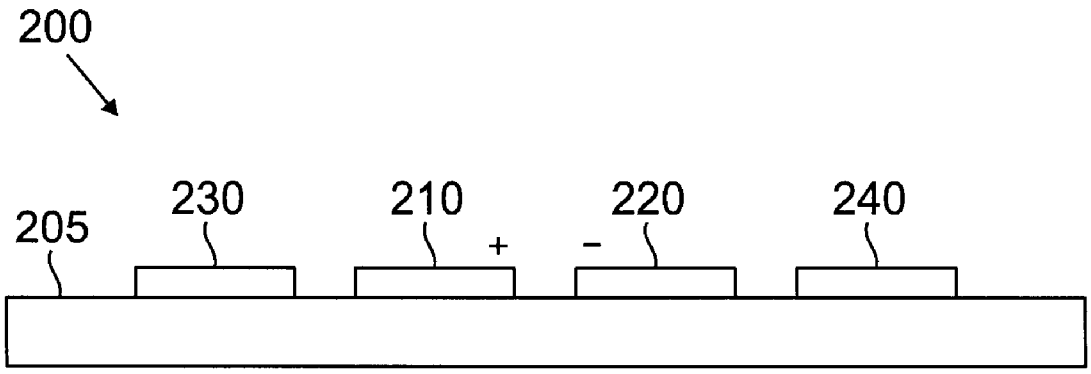
FIG. 2 (PRIOR ART)
FIG. 2 illustrates a pair of conventional flexible electrical connecting elements of FIG. 1 interconnected to permit differential-mode signaling.

Another feature of the present invention is that the + and – lines of the differential transmission line can be arranged as to connect straight through, as shown in FIGS. 3A–C, or can be arranged to cross or reverse the + and – lines left to right and right to left (not shown). Crossing high-speed differential lines in this manner would be impractical for the prior art constructions, such as those shown in FIG. 2. This ability to cross lines adds an important degree of freedom to integrated circuit (IC) and package designs.

It is to be understood that the embodiments and variations shown and described herein are merely illustrative of the principles of this invention and that various modifications may be implemented by those skilled in the art without departing from the scope and spirit of the invention.

We claim:

1. An electrical connecting element, comprising a dielectric substrate having two sides, wherein a first conductor path is arranged only on a first one of said sides and a second conductor path is arranged only on a second one of said sides, wherein said first conductor path carries a signal of opposite polarity to said second conductor path and said first and second conductor paths are substantially aligned, wherein said first and second conductor paths have output means that are substantially aligned with said first and second conductor paths and a pair of grounding strips positioned on one of said sides of said dielectric substrate on either side of one of said conductor paths.

2. The electrical connecting element of claim 1, wherein a virtual ground exists between said first and second conductor paths.

3. The electrical connecting element of claim 1, wherein said dielectric substrate is flexible.

4. The electrical connecting element of claim 1, wherein said dielectric substrate is composed of a polyimide film.

5. The electrical connecting element of claim 1, wherein said dielectric substrate has a small loss tangent.

6. The electrical connecting element of claim 1, wherein said dielectric substrate has a uniform thickness.

7. The electrical connecting element of claim 1, wherein said first and second conductor paths are composed of copper.

8. The electrical connecting element of claim 1, wherein said first and second conductor paths have high conductivity.

9. The electrical connecting element of claim 1, wherein said first and second conductor paths are smoothly finished.

10. The electrical connecting element of claim 1, wherein said first and second conductor paths separate at an end of said dielectric substrate to facilitate interconnection to a device with connection points separated in an interconnection plane.

11. The electrical connecting element of claim 1, wherein said first and second conductor paths provide a straight through interconnection.

12. The electrical connecting element of claim 1, wherein said first and second conductor paths provide a crossed interconnection.

13. A method for grounding an electrical connecting element, comprising the steps of:

positioning a first conductor path only on a first side of a dielectric substrate and a second conductor path only on a second side of said dielectric substrate substantially aligned with said first conductor path, wherein said first and second conductor paths have output means that are substantially aligned with said first and second conductor paths; and employing differential-mode signaling on said first and second conductor paths such that said first conductor path carries a signal of opposite polarity to said second conductor path to establish a virtual ground between said first and second conductor paths and the step of positioning a pair of grounding strips positioned on one of said sides of said dielectric substrate on either side of one of said conductor paths.

14. A method for providing an electrical connecting element with a desired characteristic impedance, comprising the steps of:

positioning a first conductor path only on a first side of a dielectric substrate and a second conductor path only on a second side of said dielectric substrate substantially aligned with said first conductor path, wherein said first and second conductor paths have output means that are substantially aligned with said first and second conductor paths; and selecting a width of said first and second conductor paths and a dielectric constant and thickness of said dielectric substrate to achieve said desired characteristic impedance and positioning a pair of grounding strips positioned on one of said sides of said dielectric substrate on either side of one of said conductor paths.

15. The method of claim 14, wherein said dielectric substrate has a small loss tangent.

16. The method of claim 14, wherein said dielectric substrate has a uniform thickness.

17. The method of claim 14, wherein said characteristic impedance of said electrical connecting element is obtained using electromagnetic simulation techniques.

18. An electrical connecting element, comprising:

a dielectric substrate;

a first and second conductor path each arranged only on opposite sides of said dielectric substrate wherein said first and second conductor paths are substantially aligned, wherein said first and second conductor paths have output means that are substantially aligned with said first and second conductor paths; and a virtual ground between said first and second conductor paths created by signals of opposite polarity carried on said first and second conductor paths and a pair of grounding strips positioned on one of said sides of said dielectric substrate on either side of one of said conductor paths.

19. The electrical connecting element or claim 18, wherein said dielectric substrate has a small loss tangent.

20. The electrical connecting element of claim 18, wherein said dielectric substrate has a uniform thickness.

21. The electrical connecting element of claim 18, wherein said first and second conductor paths have high conductivity.

22. The electrical connecting element of claim 18, wherein said first and second conductor paths are smoothly finished.

23. The electrical connecting element of claim 18, wherein said first and second conductor paths separate at an end of said dielectric substrate to facilitate interconnection to a device with connection points separated in an interconnection plane.

24. The electrical connecting element of claim 18, wherein said first and second conductor paths provide a straight through interconnection.

25. The electrical connecting element of claim 18, wherein said first and second conductor paths provide a crossed interconnection.

* * * * *